United States Patent [19]

Clanton

[11] 4,174,588

[45] Nov. 20, 1979

[54] TOY BLOOD PRESSURE MONITORING DEVICE

[75] Inventor: W. Porter Clanton, East Aurora, N.Y.

[73] Assignee: The Quaker Oats Company, Chicago, Ill.

[21] Appl. No.: 875,187

[22] Filed: Feb. 6, 1978

[51] Int. Cl.[2] ..... A63H 29/16

[52] U.S. Cl. ..... 46/44; 273/142 R; 46/56

[58] Field of Search ..... 46/44, 53, 56; 272/27 B; 40/412, 413; 273/142 R

[56] References Cited

U.S. PATENT DOCUMENTS

| | | | |
|---|---|---|---|
| 2,035,579 | 3/1936 | Wieker et al. | 273/141 R |
| 2,987,848 | 6/1961 | Neuhaus et al. | 46/44 X |
| 3,184,238 | 5/1965 | Steudkowski | 273/142 R |

FOREIGN PATENT DOCUMENTS

| | | | |
|---|---|---|---|
| 612028 | 11/1960 | Italy | 46/44 |

*Primary Examiner*—Russell R. Kinsey
*Assistant Examiner*—Mickey Yu
*Attorney, Agent, or Firm*—Cumpston & Shaw

[57] ABSTRACT

A toy blood pressure monitoring device for simulating the blood pressure monitoring instrument used by doctors. The device comprises a housing having a diaphragm on one side and a pressure indicating scale on the other side. A fan is mounted for rotation within the housing and has a pointer coupled to the fan and coacting with the scale. A manually squeezable air impelling bulb is coupled to the housing and adapted when squeezed to substantially simultaneously direct a pulse of air against the fan and diaphragm. The air pulse imparts a rotative movement to the pointer over the pressure reading scale to simulate a blood pressure reading. The pulse of air further deflects the diaphragm which if held against a person's arm simulates the person's heart pulse beat.

5 Claims, 2 Drawing Figures

TOY BLOOD PRESSURE MONITORING DEVICE

BACKGROUND OF THE INVENTION

1. Field of the Invention

The invention relates generally to toys, and more particularly to a simulated toy blood pressure monitoring device.

2. Description of the Prior Art

Toy medical kits comprising a simulated doctor's bag containing simulated medical instruments such as a thermometer, stethescope, ear monitoring device, liquid injecting device, and a blood pressure monitoring instrument are generally well known in the art. A toy blood pressure monitoring instrument normally does not contain any moving parts, and is left completely to the imagination of the child as to which parts are moving and which parts are not. In this area of toys that simulate real medical instruments, a need exists to make the medical toys more realistic and hence of greater interest to the children when playing the roles of doctor, nurse, patient or the like. Applicant's toy blood pressure monitoring device is believed to more realistically simulate an actual blood pressure monitoring instrument, and in addition simulates the heart beat of the patient.

SUMMARY OF THE INVENTION

In accordance with a preferred embodiment of the invention, a toy blood pressure monitoring device is disclosed for simulating a real blood pressure monitoring instrument. In addition, the toy blood pressure monitoring device of this invention further simulates the pulse beat of the patient while his blood pressure supposedly is being monitored.

In the broadest aspect of this invention, the toy blood presssure monitoring device comprises a housing having an open side covered by a flexible diaphragm, and a pressure indicating scale on the opposite side. A fan is mounted for rotation within the housing and has a pointer on the fan coacting with the scale. An air impelling means is coupled to the housing and adapted when operated for substantially simultaneously directing intermittent pulses of air into the housing against the fan and diaphragm. The pulses of air impart intermittent rotation to the fan for rotating the pointer around the pressure reading scale to simulate a blood pressure reading. In addition, the pulses of air are directed against the diaphragm for repetitively deflecting the diaphragm to simulate a heart pulse beat.

In a more specific aspect of the invention, the toy blood pressure monitoring device of this invention has a disk covering the open side. The disk is slidably mounted on the fan hub and is in engagement with the diaphragm. The disk is slid downwardly on the hub against the diaphragm when the bulb is squeezed.

In still another aspect of the invention, the monitoring device has means coupled to the housing for releasably securing the device onto a person's arm with the diaphragm in engagement therewith.

In a more specific aspect of the invention, the securing means comprises a flexible strip having an intermediate portion thereof secured to the housing and covering the open end and disk to form the diaphragm. The end portions of the flexible strip are securable together by Velcro (trademark) or the like for securing the device to the person's arm.

The invention and its advantages will become more apparent from the detailed description of the preferred embodiment presented below.

BRIEF DESCRIPTION OF THE DRAWING

In the detailed description of the preferred embodiment of the invention presented below, reference is made to the accompanying drawing, in which.

DESCRIPTION OF THE PREFERRED EMBODIMENT

Figure 1:
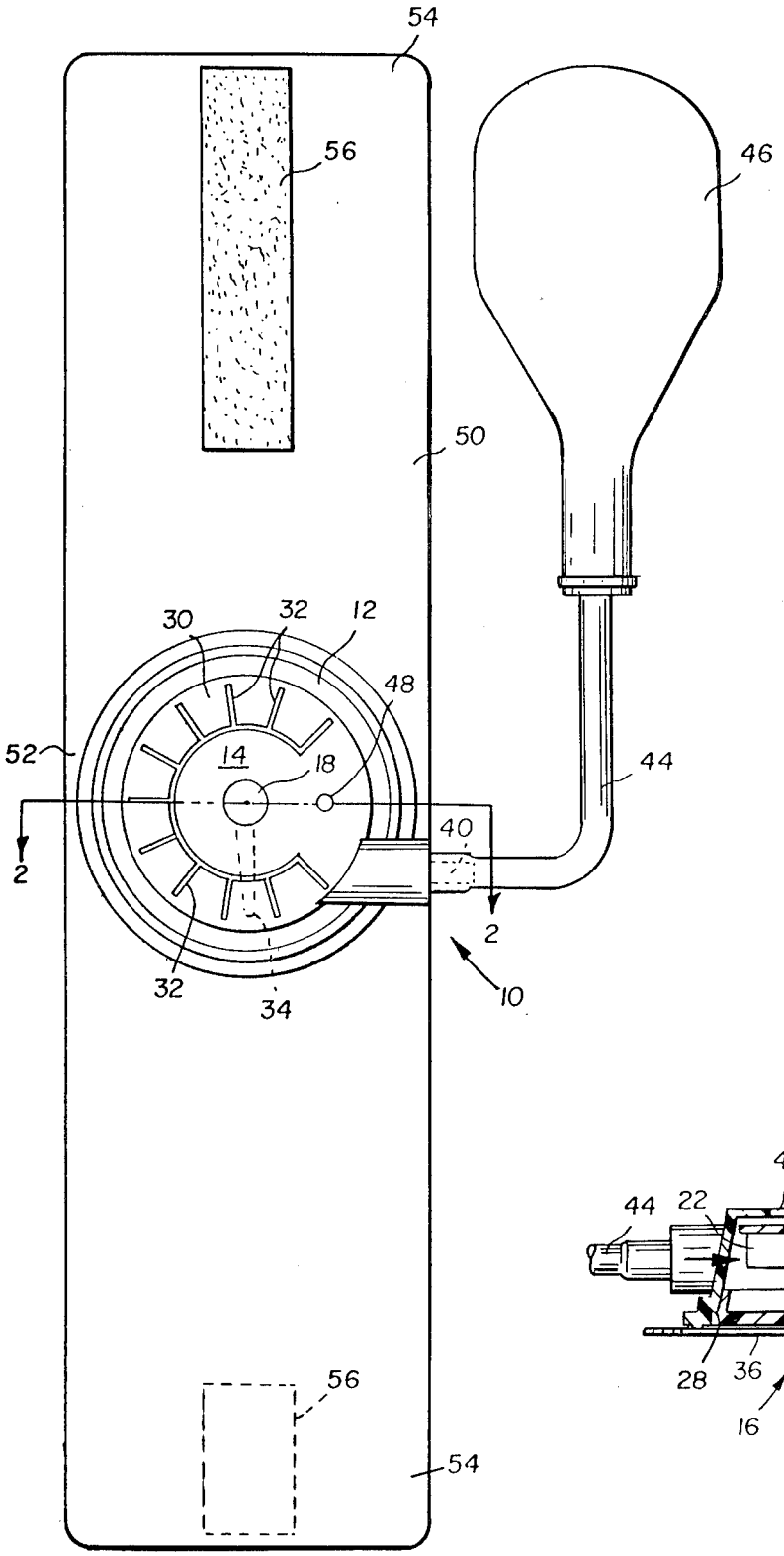
FIG. 1 is a top plan view of the toy blood pressure monitoring device of this invention.
Figure 2:
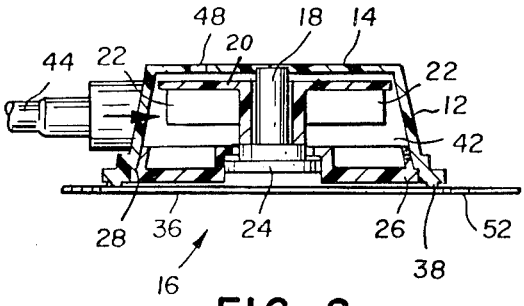
FIG. 2 is a section view taken substantially along line 2—2 of FIG. 1.

With reference to FIGS. 1 and 2, a preferred embodiment of a toy blood pressure monitoring device 10 is disclosed comprising a cup-shaped housing 12 having a transparent top 14 and an open end 16. The top 14 has a depending post 18 for rotatably supporting a fan 20 having a plurality of radially extending blades 22. The fan 20 is retained on post 18 by an enlarged end portion 24 on the post.

A circular disk 26 has a central opening through which post 18 extends. The disk 26 is retained on post 18 by the aforementioned end portion 24 and is slidably movable on the post due to the action of air impelling means to be described hereinafter. The slidable movement of the disk 26 is limited between enlarged end portion 24 defining the lowermost position of the disk and an annular surface 28 on housing 12 defining the uppermost position of the disk.

A pressure indicating scale or indicia 30 is provided on the upper surface of transparent top 14. The scale 30 may be formed by grooves or indentations 32 in top 14 which are inked or painted.

A radially extending pointer 34 is provided preferably formed by a colored indentation on the upper surface of fan 20. The pointer 34 is underneath and partially in register with scale 30 and rotates around the scale upon rotation of fan 20.

A diaphragm 36 of any suitable flexible material is secured by any suitable means such as welding to the bottom surface of housing 12. Preferably, the bottom surface of housing 12 is provided with an annular rib 38 and the diaphragm is sealingly pressed into engagement with the surfaces thereof to form an excellent leakproof seal. The diaphragm 36 covers the lower surface of disk 26.

Air impelling means are provided for imparting repetitive pulses of air into housing 12. The air pulses are directed against the blades 22 of fan 20 for rotating the fan and pointer 34 around the pressure indicating scale 30. The pulses of air are also substantially simultaneously imparted against disk 26 for slidably moving the disk against diaphragm 36 simulating a heart pulse beat. The impelling means comprises a nipple 40 on the outer periphery of housing 12 having a passageway extending therethrough in communication with a cavity 42 within housing 12. A rubber tube 44 or the like has one end fitted over nipple 40 and the opposite end secured to a bulb 46 formed of any suitable flexible material. Accordingly, when bulb 46 is manually depressed and released repetitively simulating a doctor monitoring a patient's blood pressure, repetitive pulses of air are directed through nipple 40 against fan blades 22 and disk 26 during each depression of the bulb. Each time bulb 46 is released, a decreased pressure is generated in cavity 42 causing disk 26 to slide upwardly toward annular surface 28 and air to be drawn into the bulb through an air hole 48 in top 14 of housing 12. The pulses of air substantially simultaneously impart intermittent rotation to fan 20 for repetitively rotating pointer 34 around pressure indicating scale 30. The repetitive pulses of air directed into cavity 42 are also directed against disk 26 and diaphragm 36 whereby the diaphragm is repetitively deflected to simulate a patient's heart pulse beat.

Means are coupled to housing 12 for releasably securing device 10 to a person's arm with diaphragm 36 in engagement therewith. The securing means comprises a flexible strip 50 having an intermediate portion 52 thereof secured by welding or the like to annular rib 38 and the lower surface of housing 12 for forming the diaphragm 36 covering disk 26. The end portions 54 of strip 50 have strips 56 of Velcro (trademark) thereon adapted when pressed together to secure the device 10 to the person's arm. Although a flexible strip 50 is preferred as the securing means, other types of securing means can be readily used such as, for example, an elastic band or a flexible strip secured together by a buckle.

The invention has been described in detail with particular reference to a preferred embodiment, but it will be understood that variations and modifications can be effected within the spirit and scope of the invention as described.

What is claimed is:

1. A toy blood pressure monitoring device comprising:

a housing having an open side and a pressure indicating scale on the opposite side;

a flexible diaphragm covering said open side;

a fan mounted for rotation in said housing;

a pointer coupled to said fan and coacting with said scale; and air impelling means coupled to said housing for substantially simultaneously directing repetitive pulses of air against said fan whereby intermittent rotation is imparted to said fan for repetitively moving said pointer over said pressure indicating scale, and against said diaphragm whereby said diaphragm is repetitively deflected to simulate a heart pulse beat.

2. The blood pressure monitoring device of claim 1, and further comprising means coupled to said housing for releasably securing the device on a person's arm with said diaphragm in engagement therewith.

3. The blood pressure monitoring device of claim 2 wherein said securing means comprises a flexible strip having an intermediate portion thereof secured to said housing and forming said diaphragm, and end portions thereof securable together for securing the instrument to the person's arm.

4. The blood pressure monitoring device of claim 1 wherein said housing is cup-shaped and has a transparent top having a depending post, said fan has a plurality of blades against which said pulses of air are directed and a hub rotatably mounted on said post, and a disk is slidably mounted on said hub and has its lower surface in engagement with said diaphragm.

5. The blood pressure monitoring device of claim 4 wherein said pressure indicating scale is on said top of said housing, and said pointer is on the upper surface of said fan and beneath said scale.

* * * * *